US005178266A

United States Patent [19]

Villa

[11] Patent Number: 5,178,266

[45] Date of Patent: Jan. 12, 1993

[54] CARRIER FOR BEVERAGE CANS THAT BREAKS APART UPON CAN REMOVAL

[76] Inventor: Donald J. Villa, 6634 Dartmouth Ave., St. Petersburg, Fla. 33710

[21] Appl. No.: 810,756

[22] Filed: Dec. 18, 1991

[51] Int. Cl.[5] ..... B65D 75/58

[52] U.S. Cl. ..... 206/150; 206/151; 294/87.2

[58] Field of Search ..... 206/150, 151, 158; 294/87.2

[56] References Cited

U.S. PATENT DOCUMENTS

| | | | |
|---|---|---|---|
| 2,936,070 | 5/1960 | Poupitch | 206/150 |
| 3,202,448 | 8/1965 | Stern et al. | 206/151 X |
| 3,374,028 | 3/1968 | Wanderer | 206/150 X |
| 4,064,989 | 12/1977 | Olsen | 206/150 X |
| 4,911,289 | 3/1990 | Bird | 206/150 |
| 4,925,020 | 5/1990 | Gordon | 206/150 |
| 5,016,750 | 5/1991 | Gordon | 206/150 |

*Primary Examiner*—Bryon P. Gehman

*Attorney, Agent, or Firm*—Joseph C. Mason, Jr.; Ronald E. Smith

[57] ABSTRACT

A carrier for beverage cans is modified so that the rings that surround the cans are broken as the cans are removed from the carrier. A pair of circumstantially spaced V-shaped notches are formed in each ring at points where the carrier bends when a can is removed so that the ring breaks at one or both notches. A line drawn through the notches is parallel to the longitudinal axis of symmetry of the carrier. Each notch is formed on the outermost edge of its associated ring.

9 Claims, 4 Drawing Sheets

CARRIER FOR BEVERAGE CANS THAT BREAKS APART UPON CAN REMOVAL

TECHNICAL FIELD

This invention relates to container packages. More particularly, it relates to a carrier for beverage containers that breaks apart when a container is removed therefrom.

BACKGROUND ART

Millions of beverages are sold each year in groups of six cans each; the six cans are held together by a plastic web that has six openings formed therein to receive the cans and which further includes finger and thumb holes to facilitate carrying of the cans as a unit. The consumer remove each can from the carrier by pulling it from its associated opening.

Although the plastic in the carriers is recyclable, many people persist in discarding them by roadways, public parks, and other areas where they may be encountered by birds and other wildlife. Even those carriers deposited in trash containers cause harm to birds that frequent landfills. There have been numerous recorded incidents of large birds, for example, having a six pack ring so tightly bound about their neck that they are unable to swallow their food and thus expire from starvation.

Only a few inventors have addressed the problem. One successful solution is disclosed in U.S. Pat. No. 5,016,750 to Gordon. The removal of containers from the Gordon carrier results in breakage of the rings, as is highly desirable. However, the breakage is accomplished by interconnecting a plastic strip between the push tab used to open the can and its associated ring; the ring is weakened where the plastic strip joins it, so that the plastic strip tears through the ring when the can is removed from the carrier. This interconnection of tab and ring requires that the plastic strip wrap around the push tab. Other embodiments of the same invention require modification of the can as well.

Another inventor, as shown in U.S. Pat. No. 3,202,448, developed a carrier having rings that separate from one another so that they may be used as coasters. However, each individual ring remains intact after it has been separated from the others.

Thus, there remains a need for a carrier having frangible rings that break open when a can is removed therefrom and which does not require modification of the can or the addition of auxiliary parts to the can and carrier construction in common use. Ideally, the rings should break in the absence of customer intention to break them and even in the presence of customer intention not to break them. The prior art, when considered as a whole in accordance with the requirements of law, neither teaches nor suggests how such a desirable carrier could be provided.

DISCLOSURE OF INVENTION

The present invention modifies the common carrier in two simple yet insightful, elegant ways and produces a carrier the rings of which break open when a beverage can is removed therefrom by a consumer.

The first modification requires that the webbing between each ring be cut a little deeper than normal. This modification introduces additional play into the rings i.e., it increases the degree of freedom thereof, particularly in the middle rings, the movement of which is more constrained than the outer rings. However, this first modification is not critical.

The second modification requires the formation of two diametrically opposed notches, or other suitable weakening means such as perforation lines, score lines, and the like, in each ring at a predetermined location. More particularly, each weakening means is formed in its associated ring at the point where the ring folds, twists or bends to a maximum extent when a beverage container is removed from the carrier. This ensures that the ring will break open when a can is pulled therefrom.

It is therefore clear that the primary object of this invention is to provide the world's first practical beverage carrier of the plastic web type that is not injurious to wildlife.

A related object is to provide such carrier in a form that does not add appreciably to the cost of manufacture of such carriers.

Still another object is to provide such carrier in a form that does not require the consumer to perform any special motions or to follow any particular directions when removing a can so that the ring will break whenever a beverage container is removed therefrom without regard to whether or not the consumer intends to cause the ring to break.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
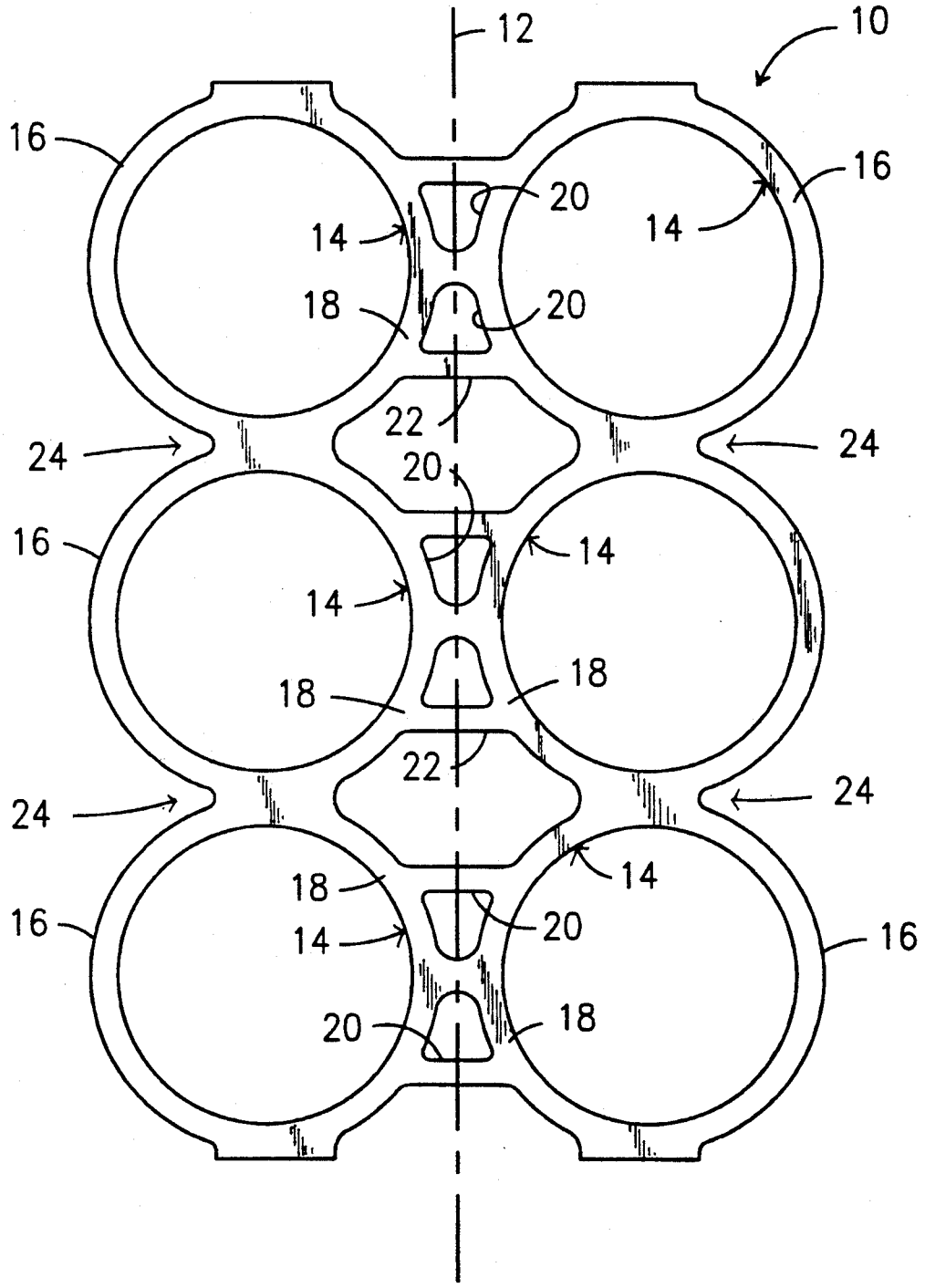
FIG. 1 PRIOR ART
FIG. 1 is a top plan view of a conventional carrier.

Referring now to FIG. 1, it will there be seen that a carrier of the prior art is denoted as a whole by the reference numeral 10.

Carrier 10 has a longitudinal axis of symmetry 12 and is made of a thin, flat sheet of frangible plastic material or webbing that includes six circular openings, collectively denoted 14. Each opening has a diameter slightly less than the diameter of a beverage can neck and is surrounded by an annular ring. The outermost part of each ring, relative to said axis of symmetry, is denoted 16 and the innermost part thereof is denoted 18. Material savings openings, collectively denoted 20, perform the function their name expresses, and finger and thumb openings 22 perform the same function and further facilitate carrying of the carrier and its contents in the well-known way.

Note the depth of the cut 24 between contiguous rings.

Figure 2:
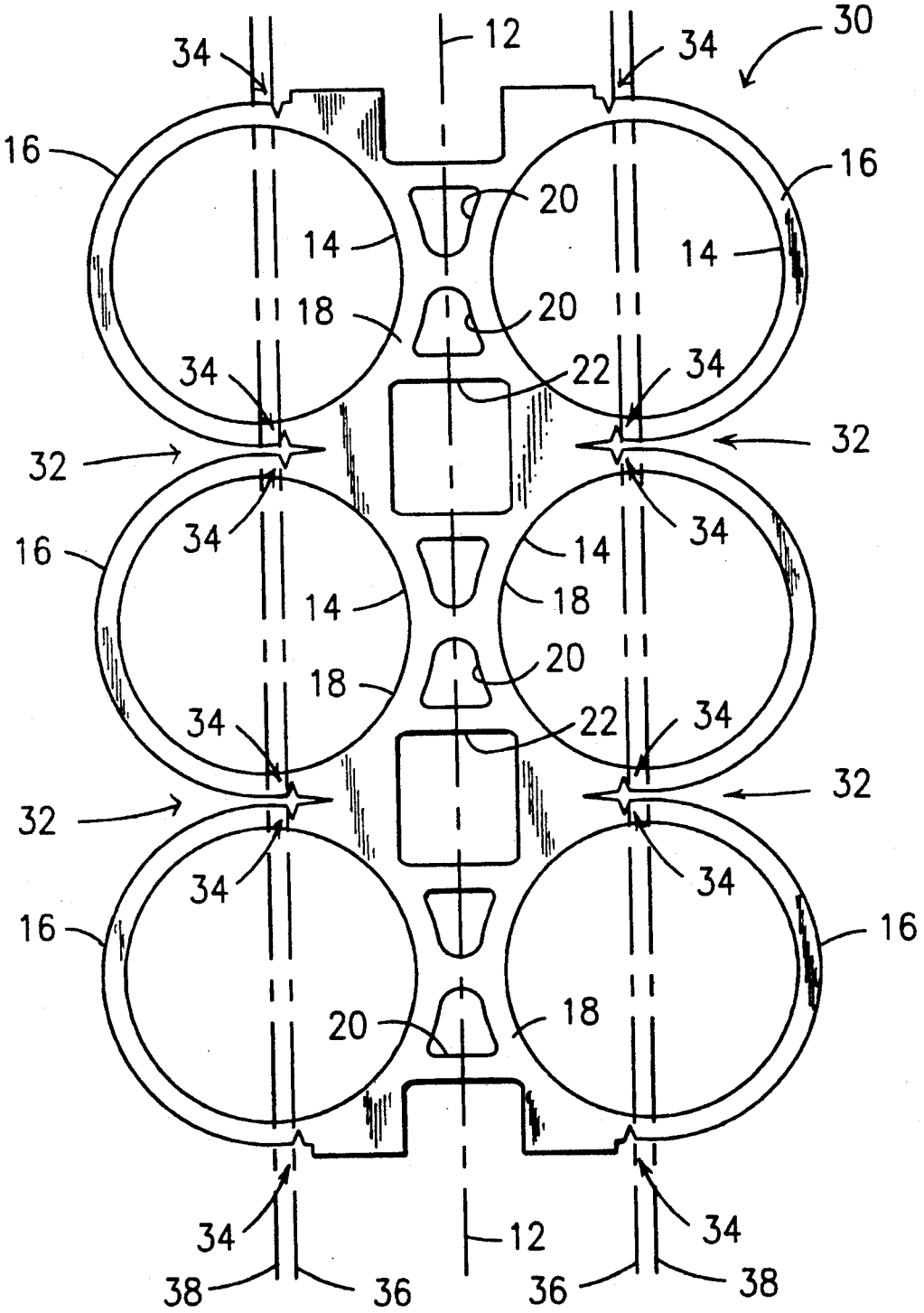
FIG. 2 is a top plan view of an exemplary embodiment of the present invention.

The inventive improvement to the carrier of FIG. 1 is ascertainable from FIG. 2 where the improved carrier is denoted 30 as a whole.

The reference numeral 32 denotes the out between the rings; by comparing cut 32 with cut 24 of FIG. 1, it will be observed that cut 32 has a greater depth, i.e., it extends closer to axis of symmetry 12 than does out 24. This provides greater freedom of movement to all of the rings, particularly the middle rings.

A plurality of notches, collectively denoted 34, are formed in each ring as shown, i.e., the notches formed in each ring are preferably diametrically opposed or substantially diametrically opposed to one another and are formed in the inboard half 18 of their associated ring. More particularly, in the preferred embodiment, line 36 drawn between the notches is parallel to the axis of symmetry 12 and is just slightly inwardly of a parallel line 38 that bisects each ring. However, this precise positioning of the notches is not critical and other positions of said notches or other weakening means are within the scope of this invention.

Figure 4:
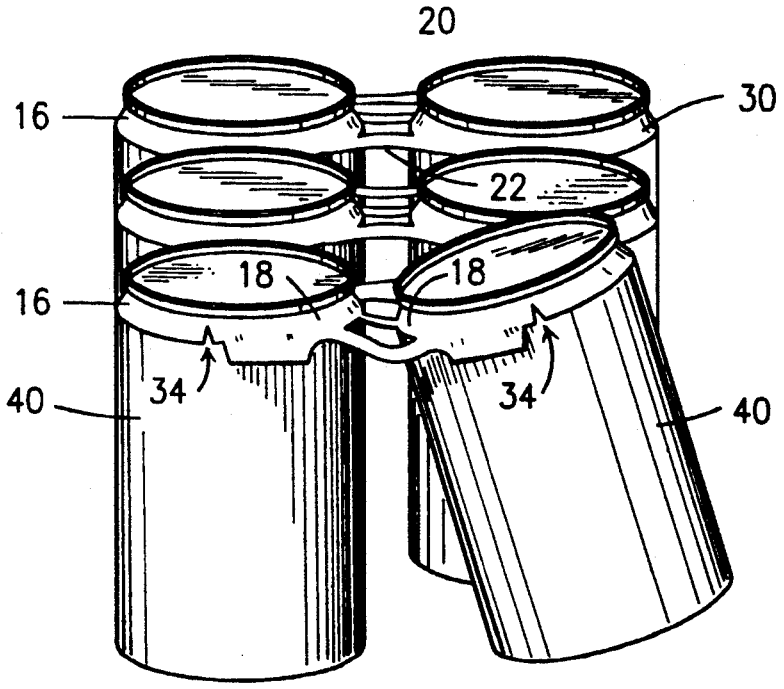
FIG. 4–6 provide an animation showing how the novel weakening means gradually breaks a carrier ring when a container is removed therefrom.
Figure 5:
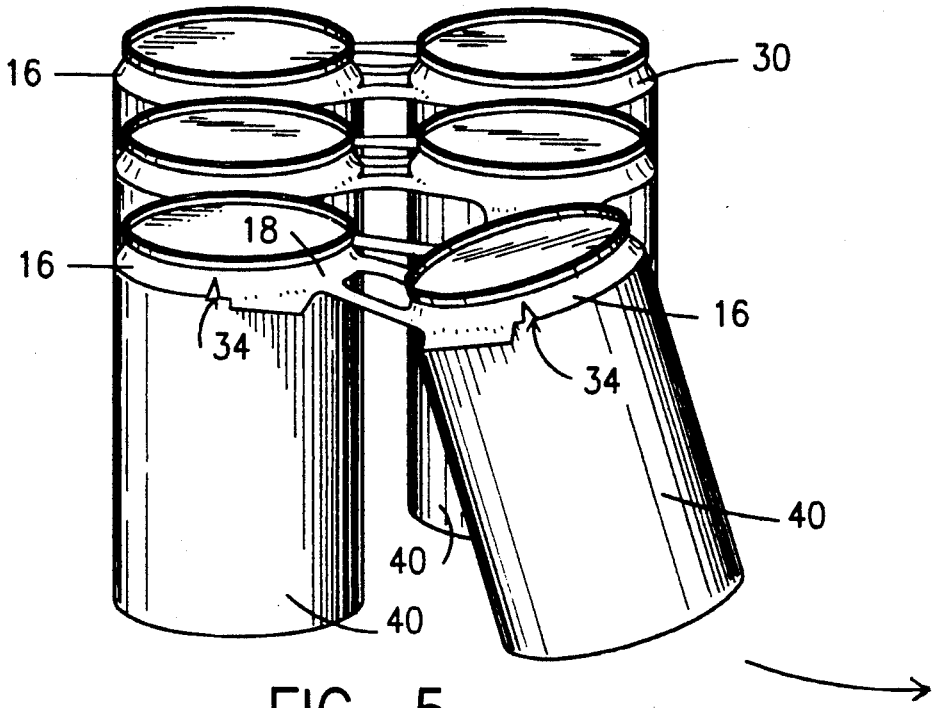
Figure 6:
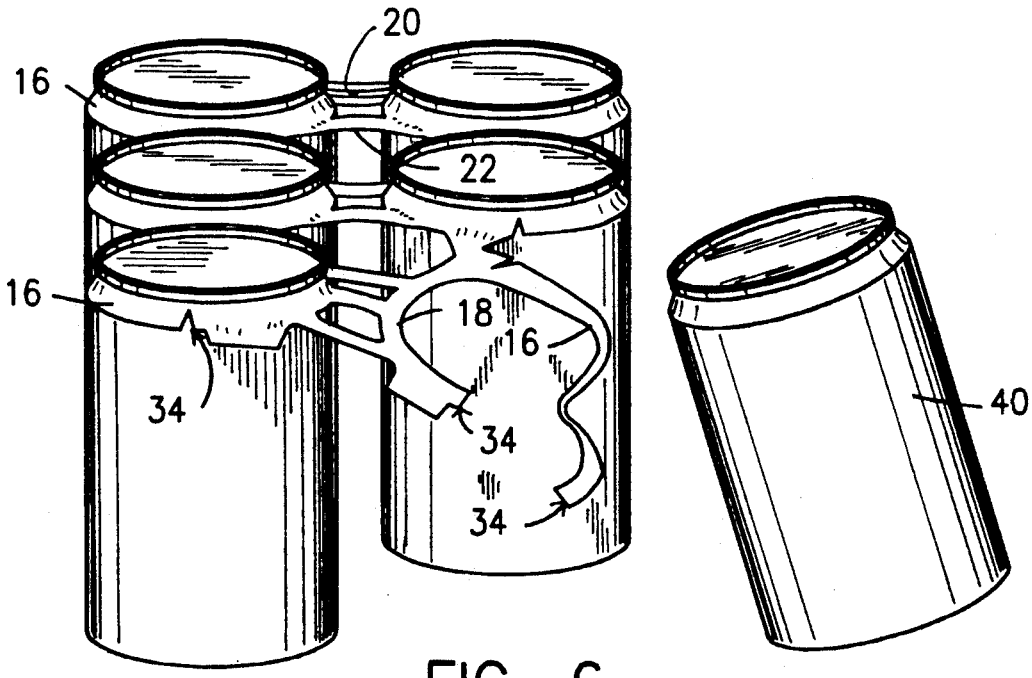

This particular positioning of notches 34 is optimal for the carrier 30; however, as aforesaid, other positions of said notches may be optimal for other carrier designs, or for carriers made of differing materials, i.e., materials that exhibit different flexibility and breaking characteristics. To determine the optimal position for the notches on any design, a beverage can is manipulated in the motion used to separate it from the carrier, and an observation is made as to where the outer part of the ring 16 bends or folds with respect to the inner part 18 of the ring. As the animation of FIGS. 4–6 shows, there is no distinct folding line but rather a return bend; the weakening means are preferably positioned at the location of the greatest curvature of the return bend.

Figure 3:
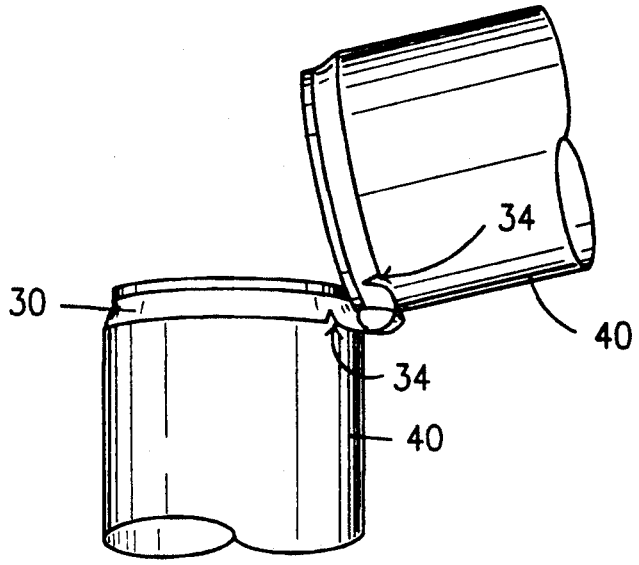
FIG. 3 is a side elevational view showing a can disposed at a ninety degree angle in relation to its position of repose.

Note also in FIG. 3 that the weakening means does not break when a can 40 is rotated ninety degrees or more from its position of repose. The customer must pull on the can to cause the ring to break.

Each notch is formed on the radially outermost edge of its associated ring, and the preferred form of each notch is a v-shaped shape. Note further that the point of greatest curvature, and hence the notches, is spaced quite close to the innermost extent of cut 32.

The return bend appears along the inboard side of each ring when a can is rotated as shown in FIG. 3, or when a can is rotated as shown in the animation. Thus, the return bend has an arcuate extent; the notches are disposed at opposite ends of each return bend because that is where the greatest curvature appears.

Tests of prototypes have shown that at least one notch will give and break open whenever a can is removed, even if care is taken to remove the can carefully as if it were desired to avoid rupture of the ring. On the other hand, the tests have shown that the notches will not break unless a can is intentionally removed from its ring, i.e., the notches do not fail spontaneously when the carrier is just being carried or otherwise manipulated as shown in FIG. 3.

In view of this disclosure, legislation is needed to ban all plastic carriers having rings that do not rupture upon removal of a can therefrom.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A carrier for beverage containers, comprising:

a thin, flat sheet of a plastic material having a plurality of circular openings formed therein, each of said openings snugly receiving a cylindrical beverage container;

each of said openings being defined by a ring of said plastic material;

each of said rings of plastic material having a radically innermost edge that contacts its associated beverage container and a radially outermost edge that does not;

a pair of weakening means formed in said outermost edge of each of said rings for weakening each of said rings;

each weakening means of each pair of weakening means being disposed substantially diametrically opposite its associated weakening means; and each weakening means being positioned where said plastic material bends when a container is removed from its associated circular opening.

2. The carrier of claim 1, wherein said plastic material forms an arcuate return bend when a container is removed and wherein each of said weakening means is positioned at a point of greatest curvature in said return bend.

3. The carrier of claim 1, wherein said carrier has a longitudinal axis of symmetry and wherein a line drawn through each opposed pair of weakening means is parallel to said axis of symmetry.

4. The carrier of claim 1, wherein each ring has an inboard part and an outboard part, said inboard part being closer to said axis of symmetry than said outboard part, and wherein said weakening means are formed in said inboard part of each ring.

5. The carrier of claim 3, wherein each of said weakening means is a notch having a v-shaped configuration.

6. A carrier for beverage containers, comprising:

a thin, flat sheet of frangible plastic material having six circular openings formed therein, each of said circular openings having a predetermined diameter slightly less than the diameter of a neck part of a cylindrical beverage can;

said sheet having a generally rectangular configuration and a longitudinal axis of symmetry;

said circular openings being grouped in two groups of three each, said groups being on opposite sides of said axis of symmetry;

each of said circular openings being circumscribed by a ring of said plastic material;

a pair of weakening means formed in each of said rings for weakening each of said rings in substantially one diametrically opposed relation to another;

each of said weakening means being formed on an outermost edge of its associated ring;

a line drawn through all of the weakening means disposed on a first side of the axis of symmetry being parallel to said axis of symmetry and being parallel to a line drawn through all of the weakening means disposed on a second side of said axis of symmetry; and each of said weakening means being disposed on an arcuate bending line that is created in said sheet of frangible plastic material when a beverage can is pulled from its associated circular opening so that the ring within which said weakening means are formed breaks upon removal of a container from said carrier.

7. The carrier of claim 6, wherein each of said rings has an outer half and an inner half of substantially equal size, said inner half being closer to said axis of symmetry than said outer half, and wherein each of said weakening means is formed in the inner half of its associated ring.

8. The carrier of claim 7, wherein each of said outer parts of contiguous rings are disposed in spaced apart relation to one another and wherein the inner parts of contiguous rings are at least in part integrally formed with one another.

9. The carrier of claim 8, wherein each of said weakening means is a notch having a v-shaped configuration.

* * * * *